US005133139A

United States Patent [19]

Rzechula

[11] Patent Number: 5,133,139

[45] Date of Patent: Jul. 28, 1992

[54] ICE RESURFACING SPREADER

[76] Inventor: Michael Rzechula, R.R. 2, Box 151, Elizabethtown, Ill. 62931

[21] Appl. No.: 638,441

[22] Filed: Jan. 4, 1991

[51] Int. Cl.[5] ..... E01H 4/00

[52] U.S. Cl. ..... 37/219; 37/232

[58] Field of Search ..... 37/219, 221, 220, 232, 37/197

[56] References Cited

U.S. PATENT DOCUMENTS

| | | | |
|---|---|---|---|
| 4,153,287 | 5/1979 | Towsend | 37/232 X |
| 4,346,928 | 8/1982 | Towsend | 37/232 X |
| 4,602,400 | 7/1986 | Agergard et al. | 37/232 X |
| 4,651,451 | 3/1987 | Beeley et al. | 37/219 |
| 4,760,657 | 8/1988 | Ganzmann et al. | 37/232 |

*Primary Examiner*—Randolph A. Reese

*Assistant Examiner*—J. Russell McBee

*Attorney, Agent, or Firm*—Wood, Phillips, VanSanten, Hoffman & Ertel

[57] ABSTRACT

An ice resurfacing spreader attachable to an ice resurfacing machine comprises an elongate spine, a plurality of elongate fibers having a free and a treating end bound by the spine away from the treating end, the fibers spaced in a fore aft and lateral direction with respect to the spine, the spine being attachable to the frame of an ice resurfacing machine so that the treating ends of the fibers lightly contact the ice surface in an ice resurfacing operation, the treating ends of the fibers being spaced sufficiently from one another to allow the passage of a resurfacing fluid therebetween and thereunder as the ice resurfacing spreader is drawn along a subjacent surface being resurfaced.

15 Claims, 2 Drawing Sheets

ICE RESURFACING SPREADER

FIELD OF THE INVENTION

This invention relates to ice resurfacing machines and, more particularly, to a spreader for evenly distributing resurfacing liquid applied by those machines to a subjacent ice surface.

BACKGROUND OF THE INVENTION

Periodically, ice rinks require resurfacing to allow for continued safe and effective use. The action of skating places substantial stresses on the ice. Chipping, scoring, and shaving buildup reduces the quality of the ice, and consequently the quality of the skating.

Resurfacing of ice rinks is normally carried out by use of a rather sophisticated ice resurfacing machine, such as that manufactured by Resurfacie Corp. of St. Jacobs, Ontario, and identified as its Olympia Model ST75. Ice resurfacing machines, such as the Model ST75, typically shave off a top layer of the ice with a large blade and then apply a layer of heated water on the newly shaved ice to form a fresh, thin, top layer of ice. A spreader attached on the rear of the machine drags along the ice surface to evenly spread the applied layer of water so that the new layer of ice is level and of generally uniform thickness.

There are a number of different types of spreaders with the flexible towel spreaders being the most predominant. Generally, these spreaders consist of one or more layers of fabric material bound together by a number of grommets passing through the layer(s) near the upper edge thereof, which grommets are also used to secure the spreader to the resurfacing machine.

Flexible towel spreaders have numerous drawbacks. First, ice resurfacing machines using such spreaders must move over the ice surface slowly. This makes the amount of time the ice resurfacing machine operator must spend resurfacing substantial, and also reduces the time available for skaters to use the ice surface. This is a problem particularly with ice rinks which rent on an hourly basis.

Ice resurfacing machines using towel spreaders must move slowly because of the undesirable "squeegee effect" conventional towel spreaders create when operated over ice surfaces at relatively high speeds. This squeegee effect is caused when conventional towel spreaders become saturated and are dragged along the ice in an ice resurfacing operation. A substantial amount of the water applied to an ice surface is thereby prevented from flowing between the towel and the ice and thus only a thin water layer passes beneath the towel spreader. The remaining water is pushed ahead of the flexible towel spreader, is chilled by the effect of the ice surface and forms a turbulent wake. In the turbulent wake air is mixed with the chilled water. Thus air passes under the towel and is deposited in the fresh layer of water in the form of an air bubble. This trapped air results in water being spread unevenly and the formation of dry spots on the ice surface.

The squeegee effect also results in water flowing over the ends of the towel spreader causing an uneven ice layer where such water freezes.

Second, through use, flexible towel spreaders become worn, shredded and torn—all of which conditions result in uneven water distribution and thereby poor, if not dangerous ice conditions.

Third, conventional towel spreaders are difficult to attach and remove from the ice resurfacing machine. In order to assure an even distribution of water, the towel must hang at a uniform height across its lateral extent. Because of the flexibility of the towel, numerous nut and bolt connections through the grommets are required. For example, the model ST75 uses 18 bolts to secure the towel. This large number of bolts makes it very time consuming to replace conventional towel spreaders. In addition, these nuts and bolts are exposed to a wide range of temperatures and a wet environment. Between the ice, the ambient temperature, and the hot water currently used for resurfacing of ice, the nuts and bolts may experience a temperature range from 15 degrees fahrenheit up to 150 degrees fahrenheit and higher. The combined effects of temperature fluctuation and humidity may degrade the nuts and bolts, further inhibiting their removal.

Finally, special additives to accelerate the ice forming process are now available to ice rink operators. While these additives have several advantages over untreated water, including faster formation of ice, certain of these additives decrease the viscosity of the water, accentuating the squeegee effect discussed above. As a result, spreader machines distributing water treated with these additives must move particularly slowly over the ice surface when using conventional towel spreader attachments.

The present invention is directed towards overcoming one or more of these problems.

SUMMARY OF THE INVENTION

In one aspect of the present invention an ice resurfacing spreader attachable to an ice resurfacing machine comprises an elongate spine or frame having a fore and aft lateral extent, a plurality of elongate fibers each having a free treating end, the elongate fibers being secured through the elongate frame in such a manner that the fibers are generally parallel and spaced in fore and aft and lateral directions with respect to the support frame. The fibers are spaced sufficiency from one another to allow passage of a resurfacing fluid therebetween as the ice resurfacing spreader is used in a resurfacing operation. The support frame is securable to the ice resurfacing machine so that the treating ends of the plurality of fibers are brought into engagement with the subjacent surface that is being treated.

In another aspect of the invention the spreader described above is used in combination with an ice resurfacing machine of the type having a front and rear, a laterally extending conditioning housing with a rigid frame portion to be positioned in close proximity to a subjacent surface to be treated and having associated means for delivering resurfacing fluid from a supply against a subjacent surface, and structure for propelling the housing across a subjacent surface to be treated. The support frame maintains the treating ends of the plurality of fibers such that they lightly contact the subjacent surface in a resurfacing operation.

In another aspect of the invention is an improvement in a process for resurfacing an ice surface using a conventional ice resurfacing machine of the type having a front and rear, a laterally extending housing with a rigid frame portion to be positioned in close proximity to a subjacent surface to be treated and having a resurfacing fluid supply deliverable to a subjacent surface, and the housing being movable across the subjacent surface. The improvement comprises attaching the resurfacing spreader described above along the lateral extent of the rigid frame portion for uniformly distributing the resurfacing fluid from the supply upon the subjacent ice surface.

It is an object of the present invention to provide an improved spreader attachment that permits a conventional ice resurfacing machine to operate at greater speeds while reducing the amount of air trapped in the new ice layer and thereby providing a smoother ice surface.

DETAILED DESCRIPTION OF THE DRAWINGS

DESCRIPTION OF THE PREFERRED EMBODIMENT

Figure 1:
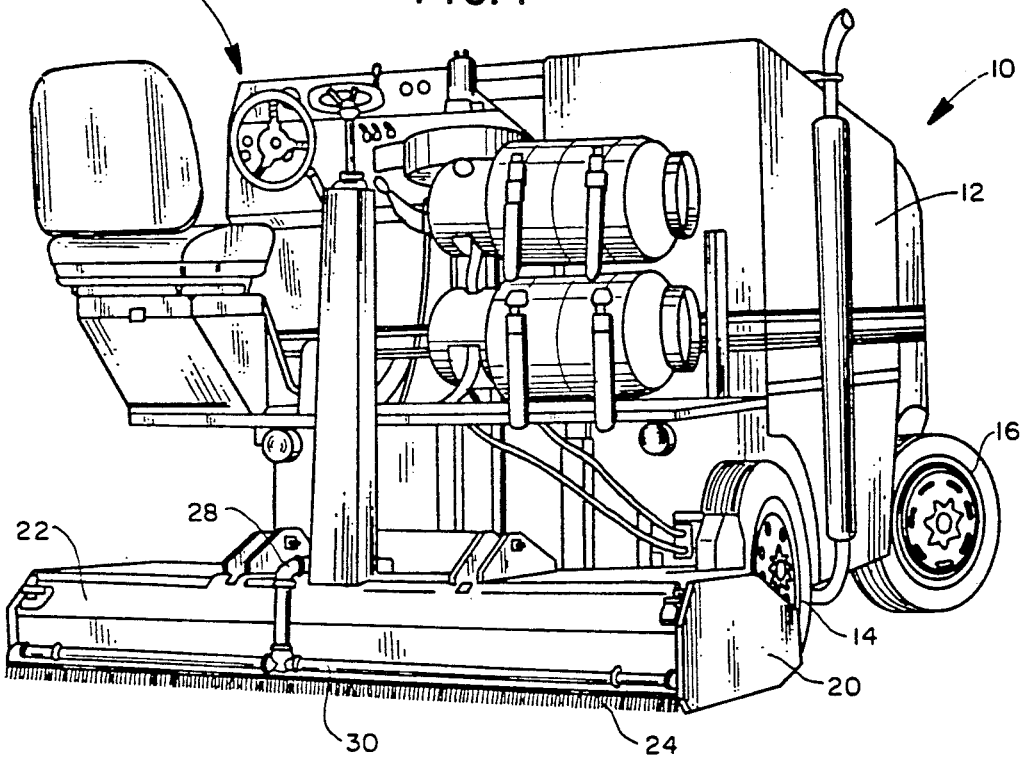
FIG. 1 is a rear perspective view of a prior art ice resurfacing machine with the spreader brush attachment in accordance with the present invention.

A prior art ice resurfacing machine, with which the present invention can be utilized, is shown in FIG. 1 at 10. The depicted machine 10 is manufactured by Resurfacie Corp. of St. Jacobs, Ontario, and identified as their Model ST75.

The ice resurfacing machine 10 has a main chassis 12 supported for movement on a pair of rear wheels 14 (one shown) and a pair of steerable front wheels 16 (one shown). A suitable power source (not shown) propels the machine 10. All operating functions of the machine 10 are controlled by an individual seated at an operator's station at 18.

The most significant portion of the machine 10, in terms of the present invention, is the conditioning section at 20. The conditioning section 20 consists of a rigid housing 22, defining an internal shrouded space in which resurfacing fluid is controllably delivered to a subjacent surface to be treated. The focus of the description herein will be on the conditioning section 20.

The housing 22 can be selectively raised and lowered by the operator. In FIG. 1, the housing 22 is shown in a lowered position. In the lowered housing position a spreader brush 24, to which the present invention is directed, extends along the lateral extent of the housing 22 and is positioned so that the bottom edge of the spreader brush 24 lightly contacts the subjacent surface on which the machine 10 is supported.

The ice resurfacing machine is capable of delivering either plain tap water or water chemically treated to improve its ice forming characteristics. One example of such a water treatment is sold under the trademark ICE ADDITIVE and distributed by Ice Technology International.

During a resurfacing operation, in addition to sweeping, scraping, etc., the machine 10 is used to spread a thin layer of resurfacing fluid over the subjacent, cooled surface to produce a thin, top layer of ice. To accomplish this, the housing 22 is lowered and a supply of resurfacing fluid is delivered through a conduit 28 to a manifold 30 through which water is distributed in an event stream across the lateral extent of the housing 22. As the machine 10 moves, the resurfacing spreader 24 skims across the subjacent surface and causes the water to be evenly distributed in a thin layer on that surface.

Figure 2:
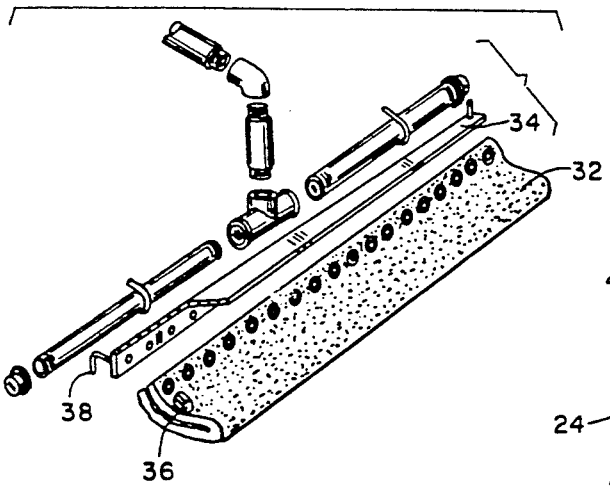
FIG. 2 (PRIOR ART)
FIG. 2 is an exploded perspective view of a conventional towel spreader attachment disposed in an operating position upon an ice surface.

The present invention is directed to an improvement over a conventional towel spreader 32 illustrated in its operating position in FIG. 2. As can be seen, the towel spreader 32 in its operating position is folded so that substantially the entire weight of the towel spreader bears upon the ice. In addition, upon being saturated the weight of the water absorbed by the towel spreader 32 also rests upon the ice. This accumulated weight leads to the undesirable squeegee effect discussed above. Finally, any ice which accumulates in front of or under the towel spreader 32 in the resurfacing operation will contribute to air (or ice crystals) being entrapped in the fresh layer of water disposed upon the ice.

The towel spreader 32 is attached to a support bar 34 by a series of nuts and bolts 36 (bolts not shown). The rigid support bar 3 in turn is attached to the manfold 30 by the means of hangers 38 provided at opposite ends of the support bar 34. The manfold 30 is rigidly attached to the housing 22.

Figure 3:
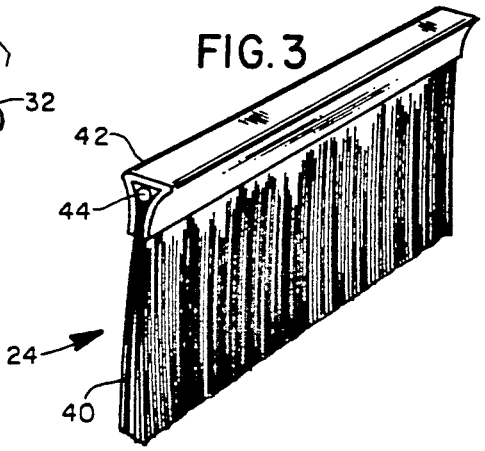
FIG. 3 is a fragmented perspective view of a spreader brush on the inventive spreader brush attachment.

The inventive ice resurfacing spreader 24 is shown in detail in FIG. 3. A plurality of resilient fibers 40 are bound and formed into a brush 24 on a U-shaped support bar or spine 42. A filler bar 44 helps secure the resilient fibers 40 in place with the spine 42 clamped around the combination of the resilient fibers 40 and the filler bar 44. In one form, the fibers 40 are doubled over the filler bar 44 and compressibly squeezed into the support bar spine 42.

In the preferred embodiment the filler bar 44 and spine 42 are made of metal. Other materials, such as plastics, may be acceptable. Using other materials may alleviate the need for the fiber bar 44 The most essential features of the spine material are the ability to securely bind the fibers and the capacity to be securely coupled to the mounting bracket 46 (see FIG. 4) or directly to the support bar 34 (see FIG. 2).

The fibers 40 may be made of man materials either natural or man made, however resilient materials are found to yield superior results. Preferably the fibers are made of polypropylene. The fibers may be of any length, with a range of 0.5 inches to 3.5 inches found to yield acceptable results. The best results have been obtained with 2 inch polypropylene fibers. The number of fibers per linear inch may vary, but a concentration of 900 to 1100 polypropylene fibers per linear inch is preferred. Fibers of a diameter between 0.01 and 0.015 inches yield acceptable results, although other diameters may also be satisfactory.

Figure 4:
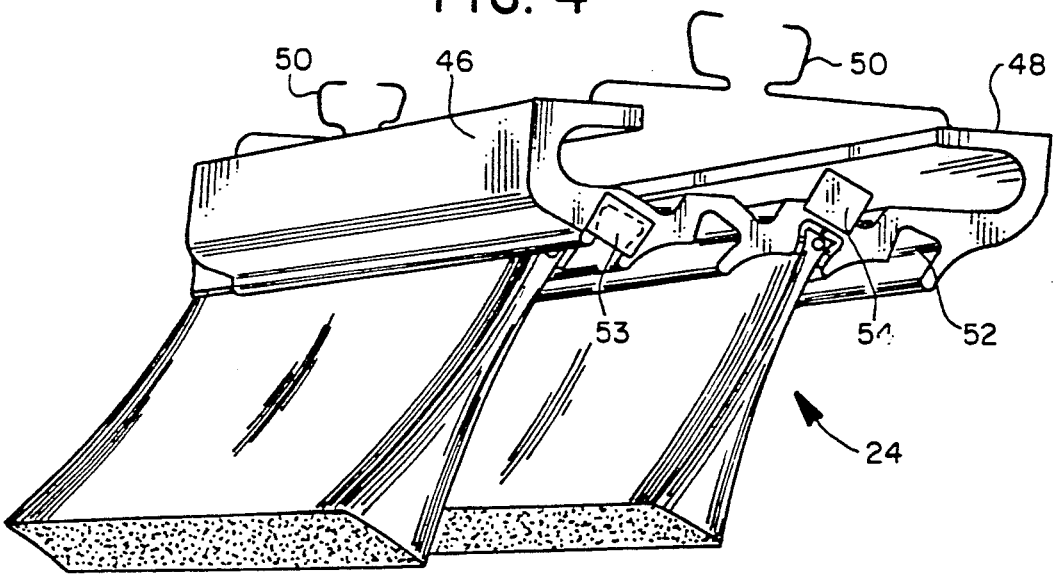
FIG. 4 is a fragmented perspective view of a mounting bracket according to the present invention for adjustably engaging the spreader brush of FIG. 3.

A coupled ice resurfacing brush 24 and mounting bracket 46 therefor according to the invention, are shown in detail in FIG. 4. Disposed on the upper surface 48 of the mounting bracket 46 are a series of clamps 50 for attaching the mounting bracket 46 to the support bar 34. As illustrated, the mounting bracket contains four grooves 52 for slidably receiving the spine 42 of the spreader brush 24. Any number of grooves is acceptable, however at least one groove is required. The mounting bracket 46 can be used in combination with at least one spreader brush 24 disposed within its grooves 52. On each end of the mounting bracket 46 are clips 53 and 54 for securing the spine 42 within the mounting bracket grooves 52. Clip 53 is illustrated in its closed position and clip 54 is illustrated in its open position.

Figure 5:
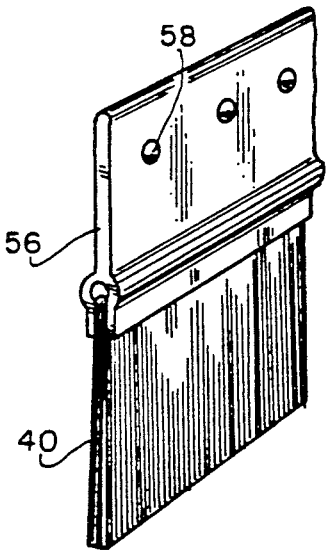
FIG. 5 is an alternative form of a spreader brush attachment according to the present invention.
Figure 6:
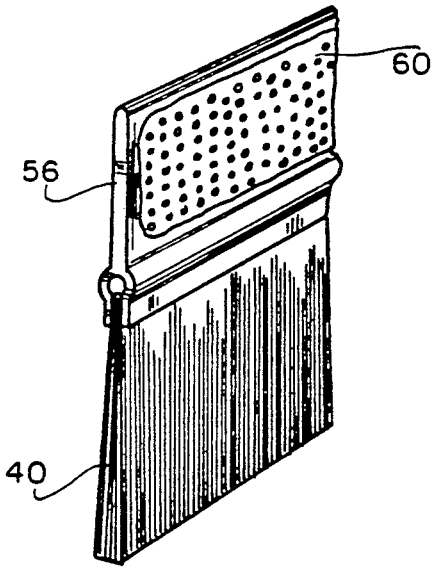
FIG. 6 is an alternative form of a spreader brush attachment according to the present invention.

The inventive ice resurfacing spreader may also be configured to be attached directly to the support bar 34. This configuration is shown in FIG. 5. In this configuration, resilient fibers 40 are bound by an enlarged spine 56 containing a series of holes 58 which may be attached to the support bar 34 by the use of any conventional fastener, including nuts and bolts. FIG. 6 illustrates an alternative embodiment wherein the resilient fibers 40 are bound by an enlarged spine 56, the enlarged spine 56 having attached thereto either the hook or loop position of a complimentary interengagable hook and loop fastener 60, commonly known as "VELCRO". The support bar 34 has the other of the complimentary hook or loop position of the VELCRO fastener attached thereto.

When the ice resurfacing spreader is used in combination with a conventional ice resurfacing machine resurfacing liquid emanating from the machine passes between and under the fibers in a uniform manner preventing the buildup of a turbulent wake. As a result, the ice resurfacing machine may run over the subjacent surface being resurfaced at a greater speed than when using towel spreaders. In addition, a reduced amount of air is trapped in the new ice surface and the formation of an uneven ice surface is minimized.

I claim:

1. An ice resurfacing spreader attachable to an ice resurfacing machine, the spreader comprising:

an elongate support frame having a fore and aft and lateral extent;

a plurality of elongate, flexible fibers each having a free treating end;

means for securing the plurality of fibers to the support frame in generally parallel relationship with the fibers spaced in both fore and aft and lateral directions with respect to the support frame; and means for securing the support frame to an ice resurfacing machine so that the treating ends of said plurality of fibers can be brought into engagement with a subjacent surface that is being resurfaced;

the treating ends of the fibers being spaced sufficiently from one another to allow passage of a resurfacing fluid therebetween as the ice resurfacing spreader is drawn along a subjacent surface being resurfaced thereby preventing a significant forerunning accumulation of the resurfacing fluid and entrainment of air therein, the fibers being close enough together to cause an even distribution of fluid along the subjacent surface during a resurfacing operation, said fibers having sufficient flexibility to allow an even distribution of resurfacing fluid on a subjacent surface to be accomplished thereby without said fibers cutting an untreated subjacent ice surface to be treated by said ice resurfacing spreader.

2. The ice resurfacing spreader of claim 1 wherein the fibers are equally flexible in all directions transverse to their lengths.

3. The ice resurfacing spreader of claim 1 wherein the means for securing the fibers comprises an elongate "U" shaped support bar, the elongate "U" shaped support bar being clamped around the plurality of fibers, the fibers being in a generally parallel relationship perpendicular to the elongate "U" shaped support bar.

4. The ice resurfacing spreader of claim 1 wherein the means for securing the support frame to an ice resurfacing machine comprises an elongate mounting bracket containing an elongate groove situated along the lateral extent of the elongate mounting bracket for slidably receiving the support frame.

5. The ice resurfacing spreader of claim 4 wherein the means for retaining retain the support frame within the mounting bracket.

6. The ice resurfacing spreader of claim 1 wherein the fibers are substantially uniformly distributed along the fore and aft and lateral extent of the support frame.

7. The ice resurfacing spreader of claim 1 wherein the concentration of fibers is in the range between 900 to 1100 fibers per linear inch.

8. The ice resurfacing spreader of claim 1 wherein the fibers are comprised of polypropylene.

9. A combination of the ice resurfacing spreader of claim 1 and an ice resurfacing machine of the type having a front and rear, a laterally extending housing attached to the rear of the resurfacing machine with a rigid frame portion in close proximity to a subjacent surface to be treated and having associated means for delivering resurfacing fluid from a supply against a subjacent surface, and means for moving the housing across a subjacent surface to be treated, where the means for securing the support frame is attached to the rigid frame portion and the treating ends of the plurality of fibers are maintained in a relationship to the subjacent surface so that the treating ends of the plurality of fibers lightly contact the subjacent surface in an ice resurfacing operation.

10. The combination of claim 9 wherein the means for securing the support frame comprises an elongate mounting bracket containing an elongate groove situated along the lateral extent of the elongate mounting bracket for slidably receiving the support frame, and means for securing the elongate mounting bracket to the rigid frame portion attached to the elongate mounting bracket.

11. The combination of claim 9 wherein the fibers are equally flexible in all directions transverse to their length.

12. The combination of claim 9 wherein the means for securing the fibers comprises an elongate "U" shaped support bar, the elongate "U" shaped support bar being clamped around the plurality of fibers, the fibers being in a generally parallel relationship perpendicular to the elongate "U" shaped support bar.

13. The combination of claim 9 wherein the fibers are substantially uniformly distributed along the fore, aft and lateral extent of the support frame.

14. The combination of claim 9 wherein the concentration of fibers is in a range between 900 to 1100 fibers per linear inch.

15. The combination of claim 9 wherein the fibers are comprised of polypropylene.

* * * * *